US008152475B2

(12) United States Patent
Sorge

(10) Patent No.: US 8,152,475 B2
(45) Date of Patent: Apr. 10, 2012

(54) METHOD FOR CONTROLLING OPERATION OF A COMPRESSOR

(75) Inventor: Kai Sorge, St.-Augustin (DE)

(73) Assignee: Continental Aktiengesellschaft, Hannover (DE)

( * ) Notice: Subject to any disclaimer, the term of this patent is extended or adjusted under 35 U.S.C. 154(b) by 227 days.

(21) Appl. No.: 10/561,422

(22) PCT Filed: Apr. 10, 2004

(86) PCT No.: PCT/EP2004/003840

§ 371 (c)(1),
(2), (4) Date: Dec. 19, 2005

(87) PCT Pub. No.: WO2005/003561

PCT Pub. Date: Jan. 13, 2005

(65) Prior Publication Data

US 2007/0098564 A1 May 3, 2007

(30) Foreign Application Priority Data

Jul. 4, 2003 (DE) ..... 103-30-121

(51) Int. Cl.
*F04B 49/10* (2006.01)
*B60G 17/018* (2006.01)

(52) U.S. Cl. ..... 417/32; 701/37

(58) Field of Classification Search ..... 417/12, 417/32; 62/211; 701/37
See application file for complete search history.

(56) References Cited

U.S. PATENT DOCUMENTS

| | | | | |
|---|---|---|---|---|
| 4,220,010 | A * | 9/1980 | Mueller et al. | 62/126 |
| 4,328,678 | A * | 5/1982 | Kono et al. | 62/126 |
| 4,462,610 | A | 7/1984 | Saito et al. | |
| 4,936,747 | A * | 6/1990 | Mitsuhashi et al. | 417/32 |
| 5,054,294 | A * | 10/1991 | Dudley | 62/228.4 |
| 5,108,264 | A * | 4/1992 | Abdel-Rahman | 417/20 |
| 5,118,260 | A * | 6/1992 | Fraser, Jr. | 417/18 |
| 5,158,436 | A * | 10/1992 | Jensen et al. | 417/32 |
| 5,168,415 | A | 12/1992 | Osuga | |
| 5,623,834 | A * | 4/1997 | Bahel et al. | 62/131 |
| 5,628,201 | A * | 5/1997 | Bahel et al. | 62/211 |
| 6,123,146 | A * | 9/2000 | Dias | 165/202 |
| 6,142,741 | A * | 11/2000 | Nishihata et al. | 417/32 |
| 6,148,628 | A * | 11/2000 | Reason et al. | 62/223 |
| 6,171,065 | B1 * | 1/2001 | Wode | 417/32 |
| 6,212,451 | B1 | 4/2001 | Kutscher et al. | |
| 6,264,435 | B1 * | 7/2001 | Renedo Puig et al. | 417/286 |
| 6,364,619 | B1 * | 4/2002 | Williams et al. | 417/32 |
| 6,398,507 | B1 * | 6/2002 | Choi | 417/32 |
| 6,468,042 | B2 * | 10/2002 | Møller | 417/44.11 |
| 6,755,590 | B1 | 6/2004 | Luetzow et al. | |
| 6,758,051 | B2 * | 7/2004 | Jayanth et al. | 62/126 |
| 6,799,950 | B2 * | 10/2004 | Meier et al. | 417/12 |

FOREIGN PATENT DOCUMENTS

| | | |
|---|---|---|
| DE | 43 33 591 A1 | 4/1995 |
| DE | 196 21 946 C2 | 9/1997 |
| GB | 1065218 | 4/1967 |
| GB | 1327055 | 8/1973 |
| GB | 2223331 | 4/1990 |

* cited by examiner

*Primary Examiner* — Charles Freay
*Assistant Examiner* — Alexander Comley

(57) ABSTRACT

In a method for controlling operation of a compressor, the compressor is shut off by a control device in order to prevent thermal damages when an estimated temperature value $T_s$ calculated by said control device exceeds an upper threshold value $T_{max}$ while the compressor remains on or is allowed to be turned on when there is a need for compression and a lower threshold value $T_{min}$ is not reached. In order to be able to more accurately estimate the estimated temperature and increase the thermal availability of the compressor, the estimated temperature value $T_s$ is indirectly and cyclically determined by means of a mathematical-physical model that characterizes the cooling and heating properties of the compressor.

10 Claims, 1 Drawing Sheet

METHOD FOR CONTROLLING OPERATION OF A COMPRESSOR

This application is the U.S. national phase of international application PCT/EP04/03840 filed Apr. 10, 2004, which designated the U.S. and which claims the benefit of priority of German Patent Application Number 103 30 121.6 filed Jul. 4, 2003. The contents of each of the aforementioned documents are incorporated herein in their entirety.

BACKGROUND OF THE INVENTION

The present invention relates to a method for controlling the operation of a compressor, in which the compressor is switched off by a control unit to avoid thermal damage if an estimated temperature value Ts(Tc) calculated by said unit exceeds an upper threshold value $T_{max}$, or remains switched on or is switched on if there is a compression requirement and if a lower threshold value $T_{min}$ is not reached.

It is generally known that compressors with which a gaseous or liquid medium can be brought to a pressure above the ambient pressure are used in motor vehicles. This gaseous or liquid medium is often used as a control pressure medium, with which for example actuators such as piston-cylinder arrangements can be acted on directly or via a pressure medium accumulator.

One application in motor vehicles arises from the necessity to supply the pneumatic springs of a level control system with compressed air in such a way that they can move the vehicle to a distance from the surface of the roadway that is appropriate for the driving situation. Since such a level control system does not constantly provide a height adjustment of the vehicle, a compressor belonging to such a system is only put into operation when the need arises according to requirements. Compressors of this type are generally formed as electromotively operated piston compressors.

In the effort to minimize the costs of compressors, small compressors are being increasingly used, with thermal problems possibly occurring if they are operated for longer periods, since their components may heat up to unallowably high levels during lengthy operation. In such cases, the damage generally occurs first at the outlet valve or at the piston seal of a piston compressor, which can ultimately lead to failure of the compressor, and consequently of the level control system.

To avoid operationally induced damage of this kind, there is for example, according to DE 15 03 466 A1, DE 19 43 936 A1 and EP 12 53 321 A2, the possibility of measuring the temperature of the compressor directly in the area of said components and, in the event of thermal overloading, switching the compressor off to cool down.

However, this type of construction entails the disadvantages that the temperature sensors necessary for this purpose are comparatively expensive and can often only be accommodated with difficulty in small compressors on account of the confined installation space in the area of interest. Although EP 12 53 321 A2 indicates that the operation of the compressor can also be controlled without temperature sensors on the basis of a thermal model, the content of such a measuring or control method is not defined.

In addition, it is known from DE 39 19 407 A1 and DE 40 30 475 A1 to determine the thermal loading of such a compressor via the electrical power consumption and/or the operating time of the electric motor belonging to the compressor. Taking a similar direction is the proposal that has become known from DE 43 33 591 A1, that of influencing the control of a compressor by adding up its individual on times and individual off times, which can be used as a measure of many influencing factors for the thermal loading of the compressor.

Another approach is disclosed by DE 198 12 234 C2, according to which a compressor can be variably operated with regard to its on and off times. In this case, the currently applicable on period at a given time is to be adapted to the currently applicable operating conditions of the compressor. Serving as parameters as a function of which the on period of the compressor is varied are the heat transfer conditions prevailing between the compressor and the air surrounding it.

In this case, the on period may be varied for example as a function of the air temperature and air flow rate prevailing in the surroundings of the compressor in such a way that the on period is shortened if the ambient compressor temperature increases and is lengthened if it decreases. The ambient compressor temperature can in this case be determined on the basis of a model calculation from the currently applicable vehicle outside-air temperature and/or the vehicle-engine intake-air temperature. The disadvantage of this method is that, like all on-period methods, it is very inaccurate, because it does not take into account the thermodynamic properties of the compressor itself. Therefore, the control does not for example have any influence on the temperature band in which the compressor is ultimately operated.

Finally, DE 196 21 946 C2 discloses a method for the temperature-assisted control of a compressor for a pneumatic suspension of a motor vehicle which takes the form of an estimating method and manages without a separate temperature sensor on the compressor. For this purpose, it is provided that the compressor is switched off by a control unit if an estimated temperature value calculated by it exceeds an upper threshold value, or is switched on, or allows switching on, if a lower threshold value is not reached. For this purpose, when the compressor is switched on, the last estimated temperature value in each case is increased by a specific temperature increment, the amount of which is dependent on the level of the last estimated value.

In this case, the estimated value is raised by a predetermined positive gradient during compressor operation and lowered by a predetermined negative gradient while the compressor is at a standstill. It is disadvantageous that the linear relationships used as a basis for this method cannot exist as such in reality, since the temperature changes are greater when there are large temperature differences than when there are small temperature differences. Furthermore, the temperature increment does not occur instantaneously in reality, so that control-related availability of the compressor is also disadvantageously lowered in this area.

Against this background, the object of the invention is to present a method by which the currently applicable temperature at a compressor component at risk of being damaged can be estimated more accurately than before, without use of a temperature sensor built into the compressor, so that such a compressor can be operated for longer than previously possible under rising component temperatures.

SUMMARY OF THE INVENTION

The solution achieving this object is provided in that the estimated temperature value Ts(Tc) of the compressor is determined indirectly and cyclically by means of a mathematical-physical model characterizing the cooling and heating properties of the compressor.

The invention is accordingly based on the realization that the operating period and availability of a compressor can be advantageously lengthened without use of a temperature sensor arranged in the area of the components that are exposed to strong thermal loading if the heating and cooling behavior of the compressor can be estimated better than before. For this purpose, in a further development of the prior art the invention proposes determining the cooling and heating properties of the compressor in the form of mathematical-physical models, storing them in a control unit and using them as a basis for controlling the operation of the compressor.

In a particularly advantageous refinement of the invention, to carry out this method it is provided that firstly physical-technical influencing variables A(Tc); B(U), which influence the estimated temperature Ts in a changing manner, are determined, that at least one relative temperature Tc, which describes the thermal state of the compressor, is determined with the aid of the influencing variables A(Tc); B(U), that subsequently the influencing variables A(Tc); B(U) are added to or subtracted from the cyclically prior value of the relative temperature Tc, so that the cyclically current value of the relative temperature Tc is obtained as the result of this calculation, that an estimated temperature Ts(Tc) of the compressor, which takes into account the heating and cooling behavior of the compressor, is then calculated from this relative temperature Tc and the ambient temperature T∞ of the compressor, and that this cyclically determined estimated temperature Ts(Tc) is finally used for carrying out a limit value comparison with a lower temperature threshold value $T_{min}$ and an upper temperature threshold value $T_{max}$, on the basis of which the operation of the compressor is controlled.

The influencing variables U, which characterize the characteristic relative temperatures $Tc_i$ in a temperature-increasing manner and are taken into account when carrying out the estimating method, include, for example, not only the ambient temperature T∞ of the compressor but also the electric voltage $U_{comp}$ at the compressor as well as the counterpressure P of the compression medium downstream of the compressor. In the case of a closed pressure system, the pressure upstream of the compressor may also be used.

In a further refinement of the invention, these temperature-increasing influencing variables U are entered in a heating function B(U), which describes the heating behavior of a specific compressor.

By contrast, in the case of the method in question, a temperature-reducing influencing variable A(Tc), in the form of a cooling function which takes into account the cooling properties of the compressor and the surroundings in which it is installed, is appropriately also used.

To carry out the calculation of a current value of the relative temperatures $Tc_{1,i}$; $Tc_{2,i}$, it is proposed that the current value of the cooling function A(Tc) is subtracted from the last predetermined or calculated values of the relative temperatures $Tc_{1,i-1}$; $Tc_{2,i-1}$ if the compressor is not in operation in the time interval considered, and the current value of the heating function B(U) is added if the compressor is in operation in the time interval considered. However, it is felt to be particularly advantageous to take the cooling function A(Tc) into account in the calculation of the relative temperature even during the operation of the compressor, since the compressor of course also gives off heat to its surroundings in this operating mode.

When the control method has started, the initial value of the relative temperatures Tc should be chosen such that the estimated temperature Ts(Tc) of the compressor corresponds to the value of the ambient temperature T∞ at the installation location of the compressor.

Since the relative temperature Ts(Tc) is not the absolute temperature of the compressor but describes the difference in temperature with respect to the temperature T∞ at the installation location of the compressor, this relative temperature Ts(Tc) can be initialized with the value zero at the beginning of the compressor control method after the compressor has been inoperative for a relatively long time. It is ensured by this procedure that the temperature estimating method according to the invention accurately supplies the ambient temperature T∞ after a lengthy cooling time.

The basic structure of the control method according to the invention, as stored for example as software in a motor vehicle control unit, can be explained with the aid of the accompanying drawing.

DETAILED DESCRIPTION OF THE DRAWING

Figure 1:
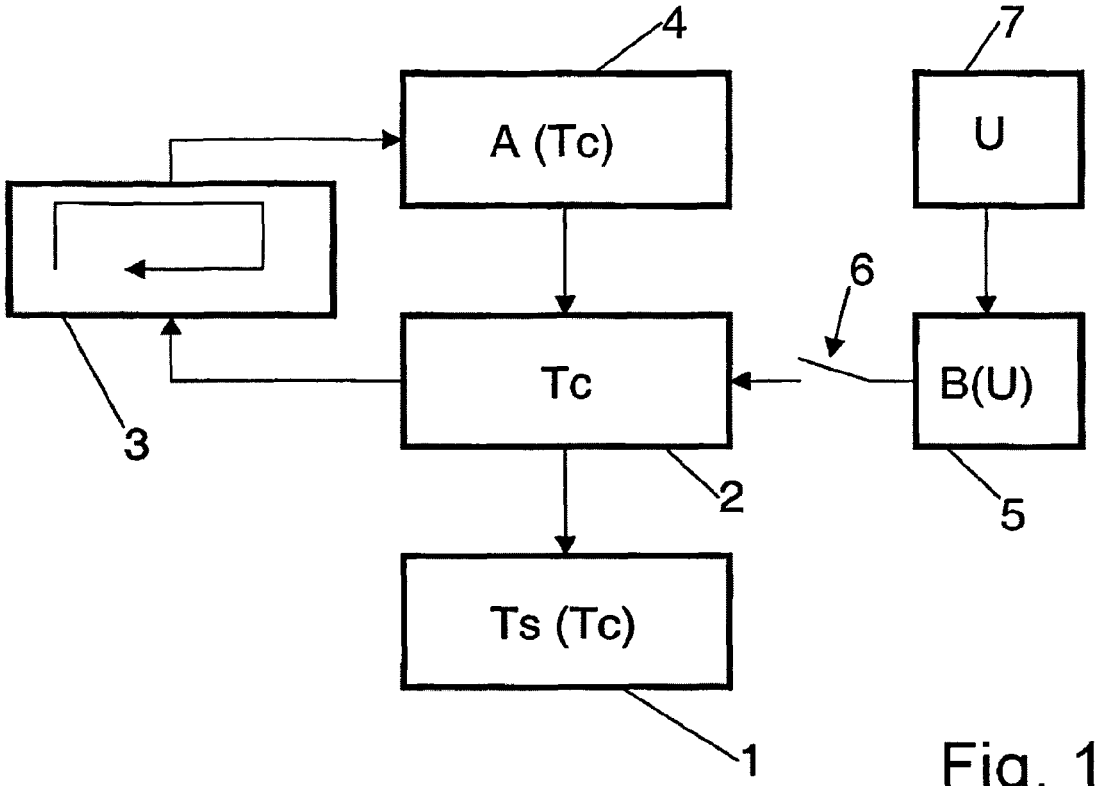
FIG. 1 shows a relative temperature module according to the invention.

Represented in FIG. 1 is a relative temperature module 2, in which that characteristic relative temperature Tc which describes the thermal state of the compressor sufficiently accurately is stored and calculated. At short time intervals, this relative temperature Tc, preferably two relative temperatures $Tc_1$; $Tc_2$, is/are newly calculated cyclically, for example under the control of a clock generator.

For this purpose, firstly that compressor cooling value by which the compressor has cooled since the last calculation cycle on account of the peculiarities of the compressor and its installation surroundings is calculated in a cooling software module 4, by means of the cooling function A(Tc) stored there and the relative temperature Tc of the last time interval made available by the holding element 3. This cooling value is then subsequently subtracted from the previous relative temperature Tc (minus sign), so that a new value for the relative temperature Tc is formed.

In particular when the compressor is in operation, it causes waste heat, which is registered by the control unit by means of heating-specific influencing variables 7 as relevant measured values and converted in a so-called heating module (main memory 5 in the control unit) with the aid of a heating function B(U) stored there into a heating value, which in the sense of a physical model takes into account all those influencing factors which act on the compressor in a temperature-increasing manner.

The value of the heating function B(U) newly calculated cyclically in this way is added to the currently applicable relative temperature Tc (switch 6 with plus sign) in particular, but not exclusively, when the compressor is switched on, so that a new relative temperature Tc, which takes into account both all the cooling influencing factors and all the, possibly to be considered, heating influencing factors, is obtained.

Then this current value for the relative temperature Tc is used to determine in an estimated temperature module 1 the cyclically currently applicable estimated temperature Ts(Tc), which is used for the further operating control (switching on or off, depending on the compression requirement and the operating temperature) of the compressor.

If the estimated temperature exceeds the allowable upper temperature limit, the compressor must be switched off. However, it is switched on if there is a compression requirement and the estimated temperature falls below a lower temperature limit value, or if it can be expected that the cooling is adequate to allow a required actuating task (for example changing the level of the vehicle) to be completely carried out without overheating.

The sequence of control steps of an actual control method which follows the idea of the invention and includes some of the advantageous developments of the invention is presented below in an exemplary embodiment of the invention. This method is characterized by the following method steps:

a) establishing the operating state of the compressor (on or off),
b) measuring the counterpressure P of the pressure medium downstream of the compressor and/or, in the case of closed systems, of the admission pressure upstream of the compressor,
c) measuring the currently applicable operating voltage $U_{comp}$ of the compressor,
d) measuring or estimating the ambient temperature T∞ of the compressor,
e) determining the validity of the influencing variables, operating voltage $U_{comp}$ and counterpressure P or the compressor inlet pressure (admission pressure),
f) calculating the current value of the heating function B(U) by using heating-specific influencing variables U,
g) calculating the current value of the cooling function A(Tc) by using the characteristic temperatures of the last time clock,
h) calculating the characteristic relative temperatures $Tc_1$; $Tc_2$ by addition and/or subtraction of the current values of the heating function B(U) and the cooling function A(Tc),
i) calculating the estimated temperature Ts(Tc) as a function of the characteristic relative temperatures $Tc_1$; $Tc_2$ and the ambient temperature T∞,
j) comparison of the estimated temperature Ts(Tc) with predetermined temperature threshold values $T_{min}$ and $T_{max}$, where $T_{min}$ is less than $T_{max}$,
k) clearance for starting if the estimated temperature Ts(Tc) is less than or equal to $T_{min}$, or authorization to continue operation of the compressor if the estimated temperature Ts(Tc) is less than the temperature value $T_{max}$,
l) switching off the compressor if the estimated temperature Ts(Tc) is greater than or equal to the temperature value $T_{max}$,
m) storing the characteristic relative temperatures $Tc_1$; $Tc_2$ for use in the next calculation run,
n) waiting until the next time clock, and
o) starting the next calculation run (step a).

In a further refinement of this method, it may also be provided that, for example, the validity of the influencing variables, operating voltage $U_{comp}$ and counterpressure P, and possibly admission pressure, is determined by these values being multiplied by the value "one" if the compressor is in operation or multiplied by the value "zero" if the compressor is not in operation. This multiplication achieves the effect that these influencing variables, variables characterizing heating of the compressor, only enter the calculation of the estimated temperature Ts(Tc) if the compressor is actually activated.

The relative temperature $Tc_1$; $Tc_2$ and the estimated temperature Ts(Tc) for a time increment i are to be calculated in this case according to the following equations:

with the compressor switched off $$Tc_i = Tc_{i-1} - A\ Tc_{i-1} \quad \text{(equation 1)}$$

and with the compressor switched on $$Tc_i = Tc_{i-1} - A\ Tc_{i-1} + B\ U_i \quad \text{(equation 2)}$$

and for the estimated temperature $$Ts_i = C\ Tc_i + T\infty \quad \text{(equation 3)}$$

in which the values A to C represent matrices with constant coefficients which characterize the compressor and the compressor surroundings, in particular with regard to their thermal properties, and, as already mentioned, T∞ indicates the ambient temperature of the compressor.

In a further advantageous refinement of the control method according to the invention, it is proposed that, even if the estimated temperature Ts(Tc) is greater than the temperature value $T_{min}$, the compressor may be switched on if the operating time of the compressor up until the upper threshold value $T_{max}$ is reached is adequate to convey an amount of pressure medium adequate for filling a compressed air accumulator to a specific pressure level and/or for filling pneumatic springs of a motor vehicle by a specific filling value.

It should also be mentioned that, whenever the functions A(Tc), B(U) and Ts(Tc) have a linear character, the parameters can be determined and/or identified simply by numerical methods directly from sensor measured values. Furthermore, it should not go unmentioned that model calculations carried out produced very good results if two characteristic model temperatures or relative temperatures $Tc_1$; $Tc_2$ were calculated.

Considered as particular advantages of this control method are that no separate temperature sensor is necessary on or in the compressor, that the thermodynamic properties of a compressor are taken into account very well by the estimating method, that the necessary calculation factors can be determined very well by existing numerical methods from measurements, that the control method can be integrated very well in existing motor-vehicle control units and that more accurate estimated temperatures can always be calculated, and as a result greater availability of the compressor can be achieved, in comparison with on-time methods according to the prior art.

LIST OF DESIGNATIONS

1 Estimated temperature module
2 Relative temperature module
3 Holding element
4 Cooling module
5 Heating module
6 Switch
7 Heating-specific influencing variables
A Matrix with constant coefficient
B Matrix with constant coefficient
C Matrix with constant coefficient
Tc Characteristic relative temperature which describes the thermal state of the compressor sufficiently accurately
A(Tc) Cooling function
B(U) Heating function
U Influencing variables which influence the relative temperature Tc in a temperature-increasing manner
$U_{comp}$ Compressor voltage
P Counterpressure of the pressure medium
Ts(Tc) Estimated temperature
$T_{max}$ Upper temperature threshold value
$T_{min}$ Lower temperature threshold value
T∞ Ambient temperature at the compressor
i Index

The invention claimed is:

1. A method for controlling the operation of a compressor, in which the compressor is switched off by a control unit to avoid thermal damage if a compressor temperature value (Ts(Tc)) calculated by said unit exceeds an upper threshold value ($T_{max}$), or remains switched on or is switched on if there is a compression requirement and if a lower threshold value ($T_{min}$) is not reached, comprising the steps of:

storing a mathematical-physical model in memory of the control unit wherein the mathematical-physical model characterizes cooling and heating properties of the compressor; and calculating a temperature value (Ts(Tc)) of the compressor indirectly and cyclically by means of the mathematical-physical model by determining physical-technical influencing variables (U), which influence the estimated temperature (Ts(Tc)) in a changing manner, determining, with the aid of the influencing variables (U), at least one relative temperature ($Tc_1$; $Tc_2$), which describes the thermal state of the compressor, adding or subtracting, for this purpose, the currently applicable influencing variables (U) from the cyclically prior value of the relative temperature ($Tc_1$, $Tc_2$), so that a currently applicable relative temperature ($Tc_1$; $Tc_2$) is obtained as the result of this calculation, determining a currently applicable estimated temperature (Ts(Tc)), taking into account the heating and cooling behavior of the compressor, from this currently applicable relative temperature ($Tc_1$; $Tc_2$) and the ambient temperature (T∞) of the compressor, and then using this cyclically calculated temperature (Ts(Tc)) for carrying out a limit value comparison with a lower temperature threshold value ($T_{min}$) and an upper temperature threshold value ($T_{max}$), on the basis of which the operation of the compressor is controlled, wherein the influencing variables (U) are entered in a heating function (B(U)), which describes the heating behavior of a specific compressor.

2. The method as claimed in claim 1, wherein, apart from other variables, the influencing variables (U) include at least one of the following quantities:

the electric voltage ($U_{comp}$) at the compressor, the counterpressure (P) of the compression medium downstream of the compressor and, in the case of closed pressure systems, the admission pressure of the pressure medium at the inlet of the compressor.

3. The method as claimed in claim 1, wherein the influencing variable (A(Tc)) represents a cooling function which takes into account the cooling properties of a specific compressor and the surroundings in which it is installed.

4. The method as claimed in claim 3, wherein, to calculate a current value of the relative temperatures ($Tc_{1,i}$; $Tc_{2,i}$), the value of the cooling function (A(Tc)) is subtracted from the last predetermined or calculated values of the relative temperatures ($Tc_{1,i-1}$; $Tc_{2,i-1}$) if the compressor is not in operation or is in operation in the time interval considered, and the value of a heating function B(U) is added if the compressor is in operation in the time interval considered.

5. The method as claimed in claim 1, wherein the relative temperature ($Tc_1$; $Tc_2$) and the calculated temperature (Ts(Tc)) for a time increment (i) are calculated according to the following equations:

with the compressor switched off $$Tc_i = Tc_{i-1} - A\ Tc_{i-1}$$

and with the compressor switched on $$Tc_i = Tc_{i-1} - A\ Tc_{i-1} + B\ U_i$$

and for the estimated temperature $$Ts_i = C\ Tc_i + T\infty$$

in which the values A to C represent matrices with constant coefficients which characterize the compressor and the compressor surroundings, in particular with regard to their thermal properties.

6. The method as claimed in claim 1, wherein the initial value of the relative temperature (Tc) is chosen such that the calculated temperature (Ts(Tc)) of the compressor corresponds to the value of the ambient temperature (T∞) at the installation location of the compressor.

7. The method as claimed in claim 6, wherein the initial value of the relative temperature (Tc) is set to the value zero at the beginning of the compressor control method.

8. The method as claimed in claim 1, comprising the following steps:

a) establishing the operating state of the compressor (on or off), b) measuring at least one on the two following pressure values: the counterpressure P of the pressure medium downstream of the compressor and, in the case of closed systems, the admission pressure upstream of the compressor, c) measuring the currently applicable operating voltage $U_{comp}$ of the compressor, d) measuring or estimating the ambient temperature T∞ of the compressor, e) determining the validity of the influencing variables, operating voltage $U_{comp}$ and counterpressure P or the compressor inlet pressure (admission pressure), f) calculating the current value of the heating function B(U) by using heating-specific influencing variables U, g) calculating the current value of the cooling function A(Tc) by using the characteristic temperatures of the last time clock, h) calculating the characteristic relative temperatures $Tc_1$; $Tc_2$ by addition and/or subtraction of the current values of the heating function B(U) and the cooling function A(Tc), i) calculating the calculated temperature Ts(Tc) as a function of the characteristic relative temperatures $Tc_1$; $Tc_2$ and the ambient temperature T∞, j) comparison of the calculated temperature Ts(Tc) with predetermined temperature threshold values $T_{mim}$ and $T_{max}$, where $T_{min}$ is less than $T_{max}$, k) clearance for starting the compressor if the calculated temperature Ts(Tc) is less than or equal to $T_{min}$, or authorization to continue operation if the estimated temperature Ts(Tc) is less than the temperature value $T_{max}$, l) switching off the compressor if the calculated temperature Ts(Tc) is greater than or equal to the temperature value $T_{max}$, m) storing the characteristic relative temperatures $Tc_1$; $Tc_2$ for use in the next calculation run, n) waiting until the next time clock, and o) starting the next calculation run (step a).

9. The method as claimed in claim 8, wherein the validity of the measured variables, operating voltage $U_{comp}$ and counterpressure P or admission pressure, is determined by these values being multiplied by the value "one" if the compressor is in operation or multiplied by the value "zero" if the compressor is not in operation.

10. The method as claimed in claim 1, wherein, even if the calculated temperature (Ts(Tc)) is greater than the temperature threshold value ($T_{min}$), the compressor may be switched on if the operating time of the compressor, until the upper threshold value ($T_{max}$) is reached, is sufficient to convey an amount of pressure medium adequate for a specific application.

* * * * *